US011383944B2

(12) United States Patent
Naramatsu

(10) Patent No.: US 11,383,944 B2
(45) Date of Patent: Jul. 12, 2022

(54) MEDIUM CONVEYING DEVICE AND LIQUID DISCHARGING DEVICE

(71) Applicant: SEIKO EPSON CORPORATION, Tokyo (JP)

(72) Inventor: Yasuo Naramatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 449 days.

(21) Appl. No.: 16/582,522

(22) Filed: Sep. 25, 2019

(65) Prior Publication Data

US 2020/0095079 A1 Mar. 26, 2020

(30) Foreign Application Priority Data

Sep. 26, 2018 (JP) ..... JP2018-180608

(51) Int. Cl.

| | |
|---|---|
| ***B65H 5/06*** | (2006.01) |
| ***B41J 2/01*** | (2006.01) |
| ***B41J 15/04*** | (2006.01) |
| ***B65H 20/02*** | (2006.01) |

(52) U.S. Cl.

CPC ..... *B65H 5/062* (2013.01); *B41J 2/01* (2013.01); *B41J 15/04* (2013.01); *B65H 20/02* (2013.01); *B65H 2404/143* (2013.01); *B65H 2801/06* (2013.01)

(58) Field of Classification Search

CPC .. B65H 5/062; B65H 20/02; B65H 2404/143; B65H 2801/06; B41J 2/01; B41J 15/04

See application file for complete search history.

(56) References Cited

U.S. PATENT DOCUMENTS

| | | | | |
|---|---|---|---|---|
| 6,719,286 | B1 * | 4/2004 | Ohyama | B65H 29/12 271/119 |
| 2013/0097226 | A1 | 4/2013 | Yu | |
| 2016/0136981 | A1 * | 5/2016 | Suzuki | B65H 23/188 226/195 |
| 2016/0272452 | A1 * | 9/2016 | Tokai | B65H 20/02 |
| 2018/0154661 | A1 * | 6/2018 | Tokai | B41J 11/64 |
| 2018/0257893 | A1 * | 9/2018 | Suzuki | B65H 20/02 |
| 2019/0092592 | A1 * | 3/2019 | Suzuki | B65H 7/06 |

FOREIGN PATENT DOCUMENTS

| | | |
|---|---|---|
| JP | 05-031987 | 2/1993 |
| JP | 2000-062286 | 2/2000 |
| JP | 2002-193472 | 7/2002 |
| JP | 2009-132522 | 6/2009 |
| JP | 2012-221506 | 11/2012 |
| JP | 2015-140000 | 8/2015 |
| JP | 2015-221506 | 12/2015 |

* cited by examiner

*Primary Examiner* — David H Banh

(74) *Attorney, Agent, or Firm* — Workman Nydegger

(57) ABSTRACT

A medium conveying device includes a driving roller configured to apply a driving force to a medium to convey the medium, a first driven roller configured to press the medium toward the driving roller, and a second driven roller arranged upstream of the first driven roller in a conveying direction of the medium, and that is configured to contact the medium entirely in an intersecting direction intersecting the conveying direction to press the medium toward the driving roller, wherein a contact portion of the second driven roller contacting the medium includes a material configured to adsorb a plasticizer of the medium, and a pressing force of the second driven roller is weaker than a pressing force of the first driven roller.

8 Claims, 8 Drawing Sheets

MEDIUM CONVEYING DEVICE AND LIQUID DISCHARGING DEVICE

The present application is based on, and claims priority from JP Application Serial Number 2018-180608, filed Sep. 26, 2018, the disclosure of which is hereby incorporated by reference herein in its entirety.

BACKGROUND

1. Technical Field

The present disclosure relates to a medium conveying device and a liquid discharging device.

2. Related Art

Typically, a medium conveying device is disclosed, which includes a driving roller that applies a driving force to a medium to convey the medium, a first driven roller configured to press the medium toward the driving roller, and a second driven roller that is arranged upstream of the first driven roller in the conveying direction of the medium and presses the medium toward the driving roller.

For example, JP-A-2012-221506 discloses a liquid discharging device as a medium conveying device that includes a driving roller, a roller row as a first driven roller, and a roller row as a second driven roller.

When the medium to be conveyed has a plasticizer, the plasticizer may reduce the performance of the medium. Accordingly, by being configured to dispose the first driven roller and the second driven roller having a material configured to adsorb the plasticizer in the contact portion with the medium, and being configured to bring the first driven roller and the second driven roller into contact with the entire portion of the medium, it is possible to remove the plasticizer from the entire portion of the medium.

However, when the first driven roller and the second driven roller are configured to have no difference in the pressing force and the like, due to a pressing force of the first driven roller and a pressing force of the second driven roller, lifting or the like may occur on the medium conveyed at the position between the first driven roller and the second driven roller in the conveying direction of the medium, and a conveyance failure may occur.

SUMMARY

The medium conveying device according to the present disclosure for solving the above problems includes a driving roller that applies a driving force to a medium to convey the medium, a first driven roller that presses the medium toward the driving roller, and a second driven roller that is arranged upstream of the first driven roller in a conveying direction of the medium, and that is configured to contact the medium entirely in an intersecting direction intersecting the conveying direction to press the medium toward the driving roller, wherein a contact portion of the second driven roller contacting the medium includes a material configured to adsorb a plasticizer of the medium, and a pressing force of the second driven roller is weaker than a pressing force of the first driven roller.

DESCRIPTION OF EXEMPLARY EMBODIMENTS

Figure 1:
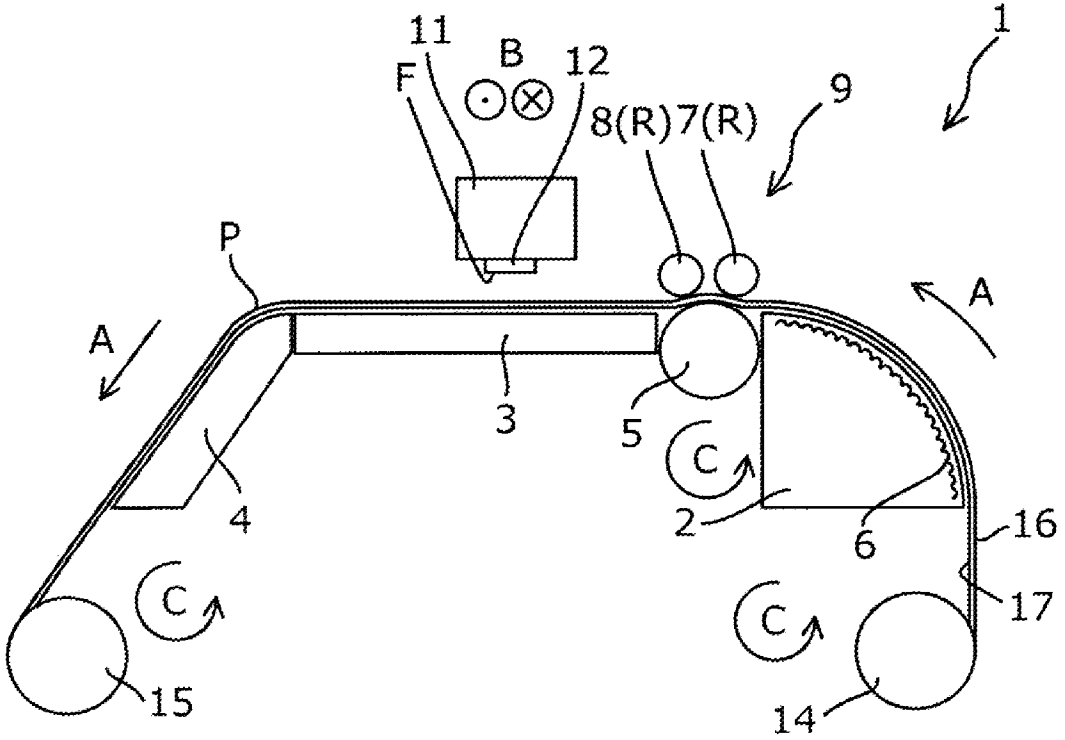
FIG. 1 is a schematic side view illustrating a liquid discharging device according to Embodiment 1 of the present disclosure.

First, the present disclosure will be schematically described.

The medium conveying device according to a first aspect of the present disclosure for solving the above problems includes a driving roller that applies a driving force to a medium to convey the medium, a first driven roller that presses the medium toward the driving roller, and a second driven roller that is arranged upstream of the first driven roller in a conveying direction of the medium, and that is configured to contact the medium entirely in an intersecting direction intersecting the conveying direction to press the medium toward the driving roller, wherein a contact portion of the second driven roller contacting the medium includes a material configured to adsorb a plasticizer of the medium, and a pressing force of the second driven roller is weaker than a pressing force of the first driven roller.

According to this aspect, it is possible to bring the second driven roller having the contact portion made from the material configured to adsorb the plasticizer of the medium into contact with the entire portion of the medium, and it is possible to remove the plasticizer from the entire portion of the medium. In addition, it is possible to separate functions into conveyance of the medium by the first driven roller with a strong pressing force and removal of the plasticizer by the second driven roller with a weak pressing force. That is, by weakening the pressing force of the second driven roller, it is possible to suppress the occurrence of lifting or the like of the medium conveyed at the position between the first driven roller and the second driven roller in the conveying direction, and it is possible to suppress the conveyance failure of the medium.

The medium conveying device according to a second aspect of the present disclosure is characterized in that, in the first aspect, the pressing force of the second driven roller is not more than 1/10 of the pressing force of the first driven roller and not less than 0.1 N.

According to this aspect, by setting the pressing force of the second driven roller to be 1/10 of the pressing force of the first driven roller or less, it is possible to effectively suppress the occurrence of lifting of the medium conveyed at the position between the first driven roller and the second driven roller in the conveying direction. In addition, it is possible to effectively remove the plasticizer by setting the pressing force of the second driven roller to be 0.1 N or greater.

The medium conveying device according to a third aspect of the present disclosure is characterized in that, in the first aspect or the second aspect, the contact portion has an SP value, which is a solubility parameter, of from 8.0 to 10.0.

According to this present aspect, it is possible to suppress unevenness of the plasticizer in the entire medium by setting the SP value of the contact portion to be from 8.0 to 10.0.

The medium conveying device according to a fourth aspect of the present disclosure is characterized in that, in any one of the first to third aspects, the second driven roller includes a roller that is configured to contact the medium entirely in an intersecting direction.

According to this aspect, the second driven roller includes the roller that is configured to contact the medium across the entire intersecting direction. With such a configuration, it is possible to easily form a removing unit of the plasticizer that is in contact with the medium across the entire intersecting direction.

The medium conveying device according to a fifth aspect of the present disclosure is characterized in that, in any one of the first to third aspects, the second driven roller includes a plurality of downstream driven rollers that are arranged at an interval in the intersecting direction, and upstream driven rollers that are arranged upstream of the downstream driven rollers in the conveying direction and press, toward the driving roller, the portion of the medium that is not pressed by the downstream driven rollers, and the downstream driven rollers and the upstream driven rollers are arranged in a staggered manner in the conveying direction.

According to this aspect, the second driven roller includes a plurality of downstream driven rollers that are arranged at an interval in the intersecting direction, and upstream driven rollers that are arranged upstream of the downstream driven rollers in the conveying direction and press, toward the driving roller, the portion of the medium that is not pressed by the downstream driven rollers, and the downstream driven rollers and the upstream driven rollers are arranged in a staggered manner in the conveying direction. With such a configuration, it is possible to bring the second driven roller into contact with the entire portion of the medium with high accuracy.

The medium conveying device according to a sixth aspect of the present disclosure is characterized in that, in any one of the first to fifth aspects, includes a first holder configured to hold the first driven roller, a second holder that is provided separately from the first holder and is configured to hold the second driven roller, a first elastic member configured to press the first driven roller toward the driving roller, and a second elastic member configured to press the second driven roller toward the driving roller.

According to this aspect, it is possible to easily form a configuration in which the first driven roller and the second driven roller press toward the driving roller so as to have a different pressing force by disposing the first driven roller and the second driven roller in different holders.

The medium conveying device according to a seventh aspect of the present disclosure is characterized by, in the sixth aspect, including a first support shaft extending in the intersecting direction, wherein the first holder includes a first hole, and the first support shaft passes through the first hole, the first holder includes a second support shaft extending in the intersecting direction, and the second holder includes a second hole, and the second support shaft passes through the second hole.

According to this aspect, by forming a configuration in which the first holder is agitated with reference to the first support shaft and a configuration in which the second holder is agitated with reference to the second support shaft, it is possible to easily form a configuration in which the first driven roller is pressed toward the driving roller and a configuration in which the second driven roller is pressed toward the driving roller.

A liquid discharging device according to an eighth aspect of the present disclosure is characterized by including the medium conveying device according to any one of the first to seventh aspects, and a discharging unit that discharges a liquid onto the medium conveyed in the conveying direction.

In a case where the medium has unevenness in the plasticizer, the spread of the liquid discharged to the medium may change, which may cause unevenness in the spread of the liquid, but according to this aspect, since unevenness of the plasticizer in the entire medium can be suppressed, unevenness of the spread of the liquid can be suppressed.

Embodiment 1

From FIG. 1 to FIG. 7

Next, the liquid discharging device according to an embodiment of the present disclosure will be described in detail with reference to the appended drawings. First, the liquid discharging device 1 having the medium conveying device 9 of Embodiment 1 with reference to FIG. 1 and FIG. 2, will be described in detail with reference to the appended drawings. Note that the liquid discharging device 1 of the present embodiment is an inkjet recording device that can use a target recording medium P having a plasticizer as a medium.

As illustrated in FIG. 1, the liquid discharging device 1 of the present embodiment conveys the target recording medium P in a conveying direction A from the setting unit 14 of the target recording medium P to the winding unit 15 of the target recording medium P via the platen 2, the platen 3, and the platen 4, which are support units of the target recording medium P. That is, a path from the setting unit 14 to the winding unit 15 is a conveyance path of the target recording medium P in the liquid discharging device 1, and the platen 2, the platen 3, and the platen 4 are support units of the target recording medium P disposed in the conveyance path. Note that the setting unit 14 rotates in the rotation direction C to deliver the target recording medium P, and the winding unit 15 rotates in the rotation direction C to wind the target recording medium P.

Note that the liquid discharging device 1 of the present embodiment is configured to be capable of performing recording on a roll-shaped target recording medium P, but the configuration is not limited to such a configuration, and may be configured to be capable of performing recording on a single-sheet target recording medium P. When a configuration is capable of performing recording on the single-sheet target recording medium P, as the setting unit 14 of the target recording medium P, for example, a so-called feeding tray, feeding cassette and the like may be used. In addition, as a collecting unit of the target recording medium P, and as a collecting unit other than the winding unit 15, for example, a so-called discharge receiving unit, discharging tray, discharging cassette and the like may be used.

Note that in the present embodiment, since a roll-type target recording medium P in which a recording surface 16 is wound so as to be outside is used, when the target recording medium P is delivered from the setting unit 14, the rotation shaft of the setting unit 14 rotates in the rotation direction C. On the other hand, when a roll-type target recording medium P in which a recording surface 16 is wound to be inside is used, the rotation shaft of the setting unit 14 can be delivered by rotating in the reverse direction of the rotation direction C.

Then, similarly, since the winding unit 15 of the present embodiment winds the recording surface 16 of the target recording medium P so as to be outside, the rotation shaft of the winding unit 15 rotates in the rotation direction C. On the other hand, when the recording surface 16 is wound to be inside, the rotation shaft of the winding unit 15 can be wound by rotating in the reverse direction of the rotation direction C.

The platen 2 of the liquid discharging device 1 of the present embodiment is provided with a heater 6. The heater 6 is disposed for heating (so-called preheating) the target recording medium P before recording is performed by a recording head 12 as a discharging unit to discharge ink which is a liquid. Note that the liquid discharging device 1 of the present embodiment is configured to use the heater 6 to preheat the target recording medium P from a surface 17 side opposite to the recording surface 16 of the target recording medium P. However, for example, the target recording medium P may be configured to be preheated from the recording surface 16 side by using a heater capable of heating the target recording medium P by irradiating infrared rays from the recording surface 16 side of the target recording medium P. While the liquid discharging device 1 of the present embodiment is capable of using the target recording medium P having the plasticizer, it is possible to effectively move the plasticizer to the surface of the target recording medium P by heating the target recording medium P with the heater 6.

In addition, the liquid discharging device 1 of the present embodiment is provided with a driving roller 5 that has a rotation shaft in an intersecting direction B intersecting the conveying direction A between the platen 2 and the platen 3, and that applies a conveying force to the surface 17 of the target recording medium P. Then, a first driven roller 8 and a second driven roller 7 having a rotation shaft in the intersecting direction B and having a driven roller R as a contact portion with the target recording medium P are disposed at positions facing the driving roller 5. Here, a pressing force on the driving roller 5 against the target recording medium P by the first driven roller 8 is configured to be stronger than a pressing force on the driving roller 5 against the target recording medium P by the second driven roller 7. That is, the first driven roller 8 and the driving roller 5 constitute a main conveying roller pair that applies a conveying force to the target recording medium P, and the second driven roller 7 and the driving roller 5 constitute a sub conveying roller pair that applies a conveying force to assist the conveying force by the main conveying roller pair, and convey the target recording medium P in the conveying direction A. Note that the driven roller means a roller that rotates with the conveying of the target recording medium P.

Figure 2:
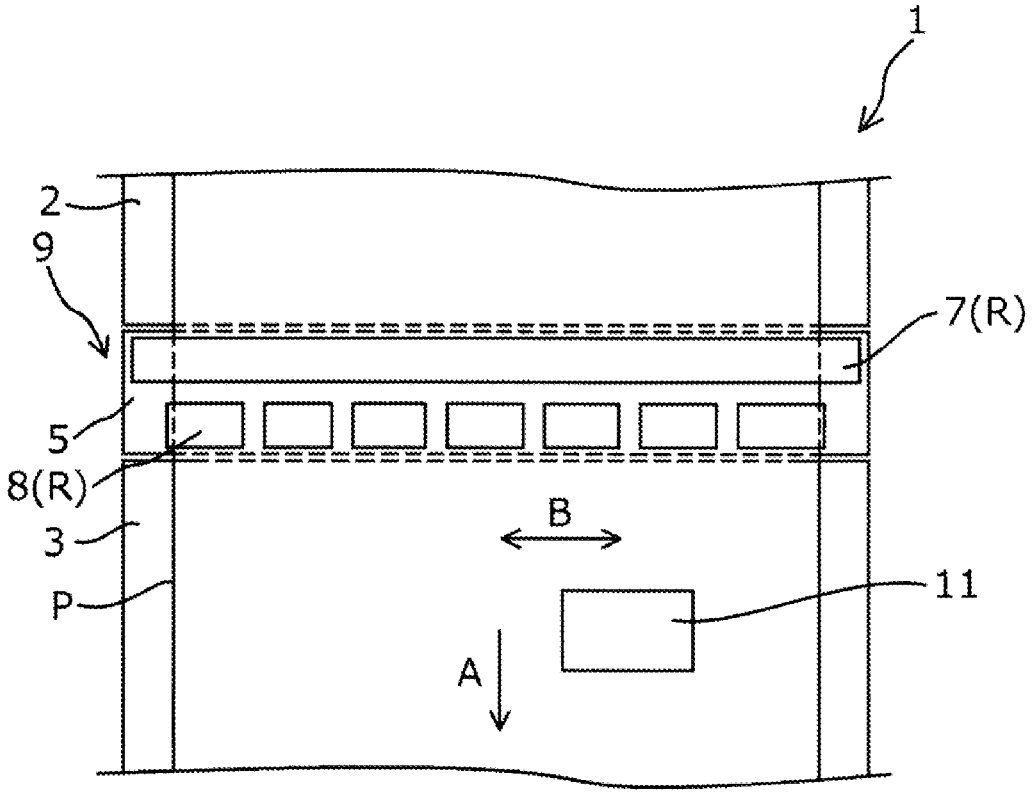
FIG. 2 is a schematic plan view illustrating the liquid discharging device according to Embodiment 1 of the present disclosure.

As illustrated in FIG. 2, the first driven roller 8 is a roller row configured by arranging a plurality of driven rollers R at intervals in the intersecting direction B, and the second driven roller 7 is a so-called single roller in which one driven roller R extends in the intersecting direction B. Then, the target recording medium P can be pinched by the driving roller 5, the first driven roller 8 and the second driven roller 7, that constitute the roller pair. With such a configuration, the driving roller 5, the first driven roller 8 and the second driven roller 7 configure the medium conveying device 9. Here, when conveying the target recording medium P in the conveying direction A, the driving roller 5 rotates in the rotation direction C, and the first driven roller 8 and the second driven roller 7 rotate in the reverse direction of the rotation direction C.

In addition, the second driven roller 7 is in contact with the entire recording surface 16 of the target recording medium P in the intersecting direction B, and serves as a removing unit that removes at least a portion of the plasticizer moved to the surface of the target recording medium P by heating the heater 6. The driven roller R of the second driven roller 7 includes a material capable of absorbing the plasticizer on the surface of the target recording medium P. Therefore, the recording surface 16 of the target recording medium P downstream of the second driven roller 7 in the conveying direction A is in a state in which at least a portion of the plasticizer is removed by the second driven roller 7 in the entire target recording medium P in the intersecting direction B. Thus, the second driven roller 7 as the removing unit may be disposed downstream in the conveying direction A of the target recording medium P of the heater 6. In the liquid discharging device 1 of the present embodiment, only the driven roller R of the second driven roller 7 is made from the material capable of absorbing the plasticizer, but the driven roller R of the first driven roller 8 may also be made from the material capable of absorbing the plasticizer.

Note that as specific examples of plasticizers contained in the medium such as the target recording medium P include various types such as phthalic acid, adipic acid, phosphoric acid, trimellitic acid and the like. Among these, diethyl phthalate is a plasticizer used in a target recording medium such as a vinyl chloride sheet or a tarpaulin used in a liquid discharging device, and there is diethyl phthalate as a plasticizer causing defects in a liquid discharge material formed on the medium.

In addition, the liquid discharging device 1 of the present embodiment is provided with the recording head 12 as a discharging unit on a side facing the platen 3 downstream in the conveying direction A from the first driven roller 8 and the second driven roller 7. The liquid discharging device 1 discharges ink onto the target recording medium P from an ink discharging surface F of the recording head 12 while reciprocating the recording head 12 in the intersecting direction B via a carriage 11 to form a desired image. With such a configuration, the recording head 12 as the discharging unit can discharge the ink in a region where at least a portion of the plasticizer is removed by the second driven roller 7 as the removing unit of the target recording medium P.

Note that although the liquid discharging device 1 of the present embodiment includes the recording head 12 for recording while reciprocating, it may be a liquid discharging device that includes a so-called line head in which a plurality of nozzles discharging ink are provided in the intersecting direction B intersecting the conveying direction A.

Here, the "line head" means a recording head that is provided such that the region of the nozzles formed in the intersecting direction B intersecting the conveying direction A of the target recording medium P can cover the entire intersecting direction B of the target recording medium P, and that is used for a liquid discharging device that relatively moves the recording head or the target recording medium P to form an image. Note that the region of the nozzles in the intersecting direction B may not be able to cover the entire intersecting direction B of all the target recording medium P to which the liquid discharging device corresponds.

Next, the electrical configuration of the liquid discharging device 1 of the present embodiment will be described with reference to FIG. 3.

A controlling unit 18 is provided with a CPU 19 that manages control of the entire liquid discharging device 1. The CPU 19 is coupled via a system bus 20 to a ROM 21 that stored various types of control programs and maintenance sequences and the like to be implemented by the CPU 19, and to a RAM 22 that can temporarily store data.

In addition, the CPU 19 is coupled to a head driving unit 23 via the system bus 20 for driving the recording head 12.

In addition, the CPU 19 is coupled to a motor driving unit 24 via the system bus 20 for driving a carriage motor 25 that moves the carriage 11, a delivering motor 26 that is a driving source of the setting unit 14, a conveying motor 27 that is a driving source of the driving roller 5, and a winding motor 28 that is a driving source of the winding unit 15.

In addition, the CPU 19 is coupled to a heater driving unit 13 via the system bus 20 for driving the heater 6.

Further, the CPU 19 is coupled to the input/output unit 31 via the system bus 20, and the input/output unit 31 is coupled to a timer 10, a PC 29 that is an external device configured to input recorded data and the like into the liquid discharging device 1.

With such a configuration, the controlling unit 18 controls each unit of the liquid discharging device 1, such as controlling the recording head 12 so that ink is discharged to the region where at least a portion of the plasticizer is removed by the second driven roller 7 as the removing unit in the target recording medium P.

Here, as described above, the liquid discharging device 1 of the present embodiment includes the heater 6 configured to heat the target recording medium P to be conveyed, and a second driven roller 7 that has a driven roller R in contact with the target recording medium P containing the plasticizer, and that removes at least a portion of the plasticizer moved to the surface of the target recording medium P by heating the heater 6. Then, it is possible to configured to form an image on the target recording medium P by discharging the ink as a liquid from the recording head 12 onto the target recording medium P in which at least a portion of the plasticizer is removed by the second driven roller 7.

The driven roller R of the second driven roller 7 is configured to contact the entire target recording medium P in the intersecting direction B as illustrated in FIG. 2. In addition, the driven roller R of the second driven roller 7 is configured from a material having an SP value, which is a solubility parameter, from 8.0 to 10.0.

A majority of the plasticizers contained in the target recording medium P tend to have a high SP value of 10 or higher. As the SP value of the plasticizer and the SP value of the contact portion with the target recording medium P become closer values, the plasticizer is more easily to be absorbed by the contact portion. The driven roller R of the second driven roller 7 as the contact portion of the present embodiment contacts the entire target recording medium P in the intersecting direction B, and has an SP value of from 8.0 to 10.0. Therefore, the plasticizer of the target recording medium P can be removed without unevenness in the intersecting direction B, and unevenness is prevented from occurring in the image formed on the target recording medium P.

In addition, as described above, the removing unit of the plasticizer of the target recording medium P according to the present embodiment includes the second driven roller 7 having a roller (driven roller R) that is in contact with the target recording medium P across the entire intersecting direction B. With such a configuration, the removing unit of the plasticizer in contact with the target recording medium P throughout the entire intersecting direction B is easily formed.

In addition, as illustrated in FIG. 1 and FIG. 2, the liquid discharging device 1 of the present embodiment includes the driving roller 5 that has the rotation shaft in the intersecting direction B, and that applies the driving force to the target recording medium P to convey the target recording medium P, and the first driven roller 8 and the second driven roller 7, which are at least two or more roller rows, are arranged to face the driving roller 5.

With such a configuration, it is possible to pinch the target recording medium P on the driving roller 5 with two or more roller rows. Thus, the area of the target recording medium P pressed against the driving roller 5 can be increased, and the conveying accuracy can be increased.

In addition, the outer diameters of the driven rollers R of the first driven roller 8 and the second driven roller 7 may be 4 mm or greater. This is because that by setting the outer diameter of the driven roller R to be 4 mm or greater, it is possible to remove the plasticizer of the target recording medium P in the intersecting direction B without unevenness and to convey the medium with high conveying accuracy. Note that, from the perspective of the upper limit of the preferred size when mounted on the liquid discharging device 1, the outer diameters of the driven rollers R of the first driven roller 8 and the second driven roller 7 may be 40 mm or less.

In addition, the heating temperature of the target recording medium P by the heater 6 may be 40° C. or higher. This is because in a case where the heating temperature of the target recording medium P is 40° C. or higher, the plasticizer can be effectively moved to the surface of the target recording medium P, and the plasticizer can be effectively removed without unevenness.

Figure 3:
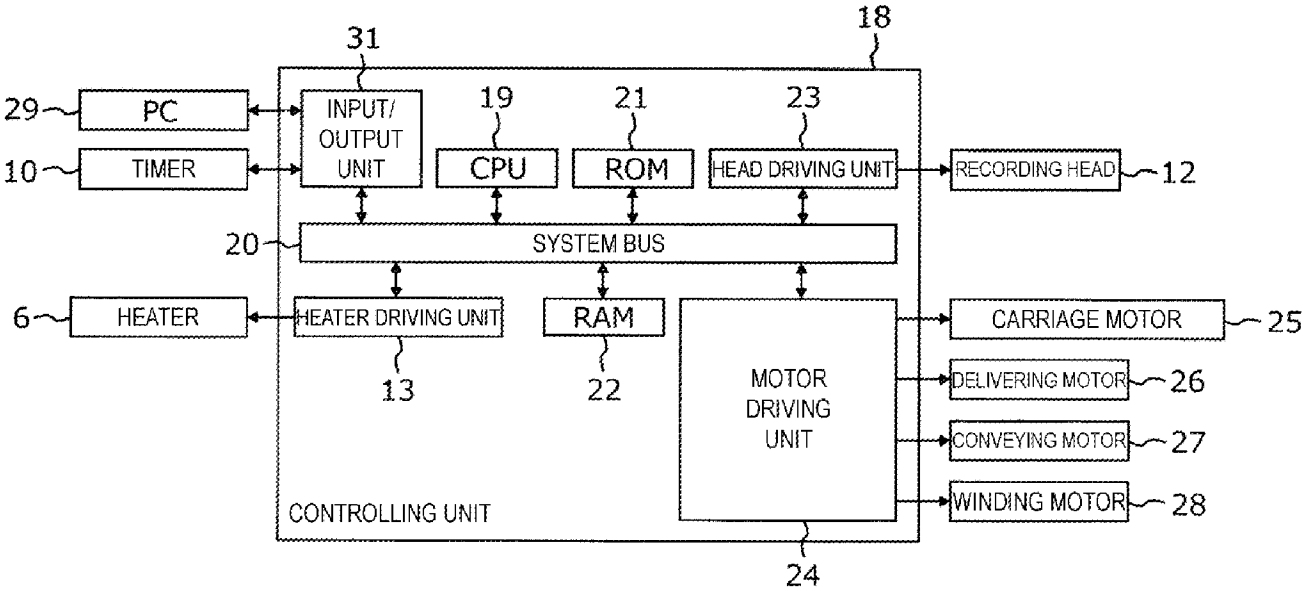
FIG. 3 is a block diagram of the liquid discharging device according to Embodiment 1 of the present disclosure.
Figure 4:
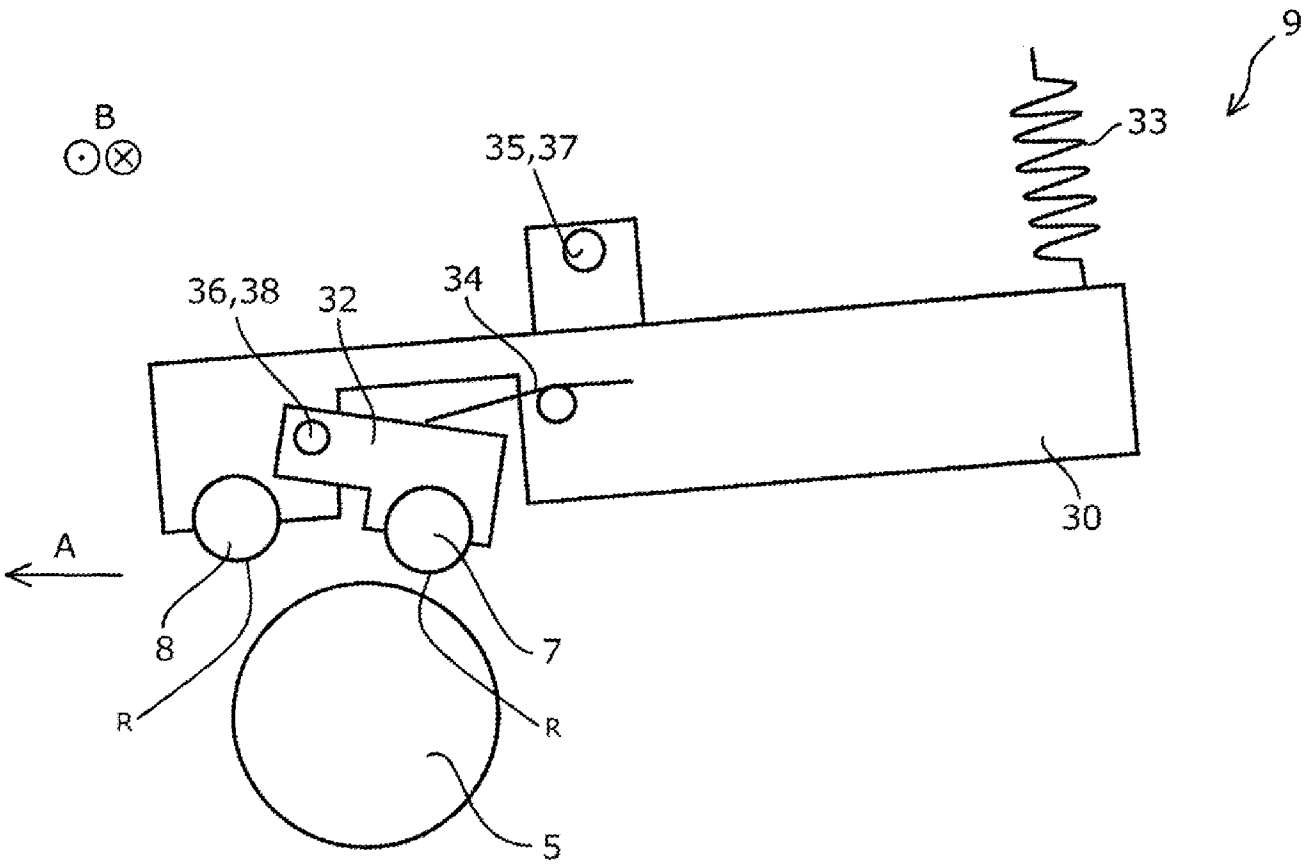
FIG. 4 is a schematic side view of a medium conveying device which is an important part of the liquid discharging device according to Embodiment 1 of the present disclosure, and illustrates an open state.
Figure 5:
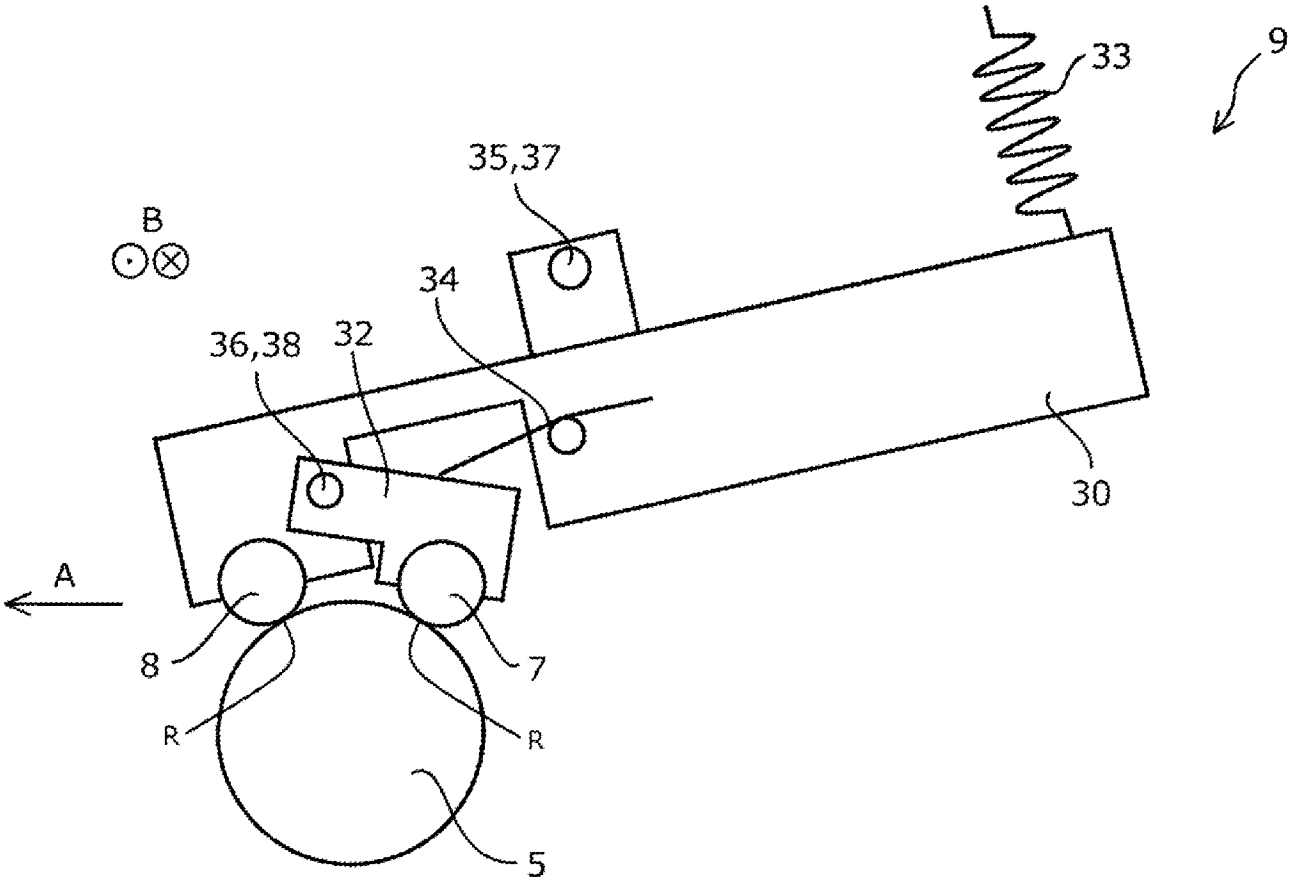
FIG. 5 is a schematic side view of the medium conveying device which is an important part of the liquid discharging device according to Embodiment 1 of the present disclosure, and illustrates a pinched state.
Figure 6:
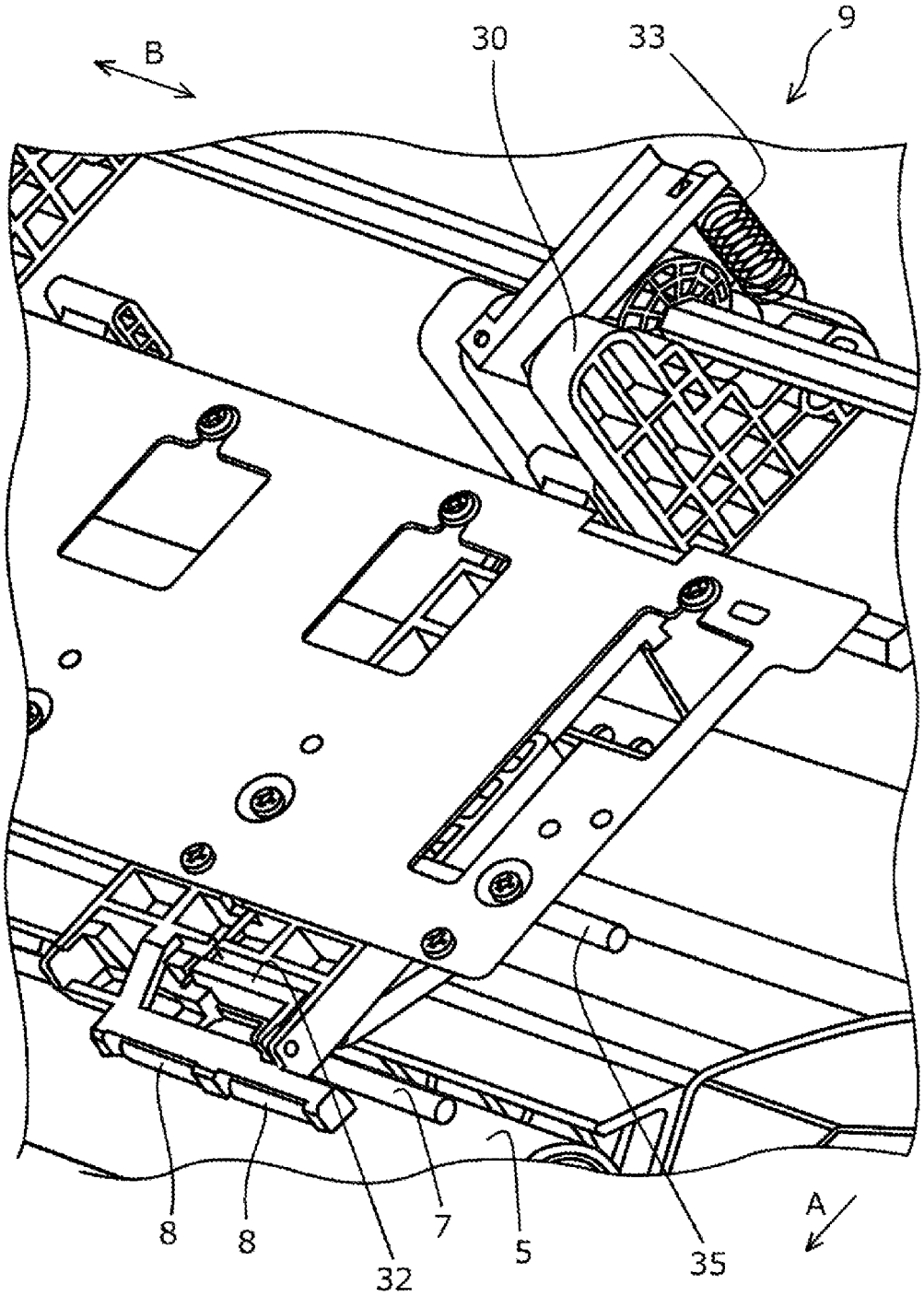
FIG. 6 is a perspective view illustrating the medium conveying device according to Embodiment 1 of the present disclosure.

As illustrated in FIG. 3, the liquid discharging device 1 of the present embodiment includes the timer 10. Then, when the predetermined period of time passes after the conveying of the target recording medium P is stopped due to control of the controlling unit 18, the first driven roller 8 and the second driven roller 7 are moved by a movement mechanism of the first driven roller 8 and the second driven roller 7, which is not illustrated, and the driven rollers R of the first driven roller 8 and the second driven roller 7 are configured to be separated from the target recording medium P. Note that FIG. 4 illustrates an open state of the first driven roller 8 and the second driven roller 7 separated from the target recording medium P, and FIG. 5 illustrates a pinched state of the first driven roller 8 and the second driven roller 7 in which the driven roller R is brought into contact with the target recording medium P. Therefore, it is configured to be capable of suppressing the occurrence of unevenness in the removal of the plasticizer by that the driven roller R continues to be in contact with a portion of the target recording medium P for longer than a predetermined time.

In addition, the ink used in the liquid discharging device 1 of the present embodiment is an aqueous ink. When the target recording medium P has unevenness in the plasticizer, the aqueous ink tends to cause unevenness in an image formed on the target recording medium P, particularly. However, the liquid discharging device 1 of the present embodiment is configured that even when the liquid discharged from the recording head 12 is an aqueous ink, it is possible to suppress the occurrence of unevenness in the liquid discharge material. Note that the ink used in the liquid discharging device 1 of the present embodiment is an aqueous ink containing water as a main solvent, but for example, a solvent ink using an organic solvent as a main solvent may be used. When the liquid discharged from the recording head 12 is an aqueous ink, for example, ethylene propylene rubber, urethane, fluorine rubber, elastomer and the like can be used. However, when the liquid discharged from the recording head 12 is a solvent ink, the elastomer may have low resistance to the solvent ink, so ethylene propylene rubber, urethane, fluorine rubber and the like may be used.

In addition, when the contact angle of the liquid discharged from the recording head 12 with respect to the target recording medium P before contact with the driven rollers R of the first driven roller 8 and the second driven roller 7 is 20° or greater and 90° or less, the configuration may be such as the present embodiment. This is due to the following reasons. When the contact angle of the liquid with respect to the target recording medium P before contact with the contact portion with the target recording medium P is 20° or greater and 90° or less, unevenness tends to occur in the liquid discharge material. However, even when the contact angle of the liquid with respect to the target recording medium P before contact with the contact portion with the target recording medium P is 20° or greater and 90° or less, it is possible to suppress unevenness in the liquid discharge material with the configuration as in the present embodiment.

Note that the contact portions with the target recording medium P corresponding to the driven rollers R of the first driven roller 8 and the second driven roller 7 of the present embodiment may have a high saturation absorption rate. This is because in a case where the saturation absorption rate is high, the plasticizer can be sufficiently absorbed from the target recording medium P, and a majority of the plasticizers absorbed by the contact portion gradually diffuse into the atmosphere, thus the plasticizer can be continuously used for a long time.

Next, the medium conveying device 9 which is an important part of the liquid discharging device 1 of the present embodiment will be described in detail with reference to FIG. 4 to FIG. 7.

As illustrated in FIG. 4 and FIG. 5 and the like, the medium conveying device 9 of the present embodiment includes a first holder 30 that holds the first driven roller 8, and a second holder 32 that is separately disposed from the first holder 30 and that holds the second driven roller 7. Then, the medium conveying device 9 of the present embodiment further includes a first elastic member 33 that is a spring pressing the first driven roller 8 toward the driving roller 5, and a second elastic member 34 that is a spring pressing the second driven roller 7 toward the driving roller 5. The medium conveying device 9 of the present embodiment is configured to press toward the driving roller 5 so that the first driven roller 8 and the second driven roller 7 have different pressing forces in order to suppress the occurrence of lifting or the like in the target recording medium P to be conveyed. The medium conveying device 9 of the present embodiment easily forms a configuration that by disposing the first driven roller 8 and the second driven roller 7 on different holders, the first driven roller 8 and the second driven roller 7 press toward the driving roller 5 so as to have different pressing forces.

Figure 7:
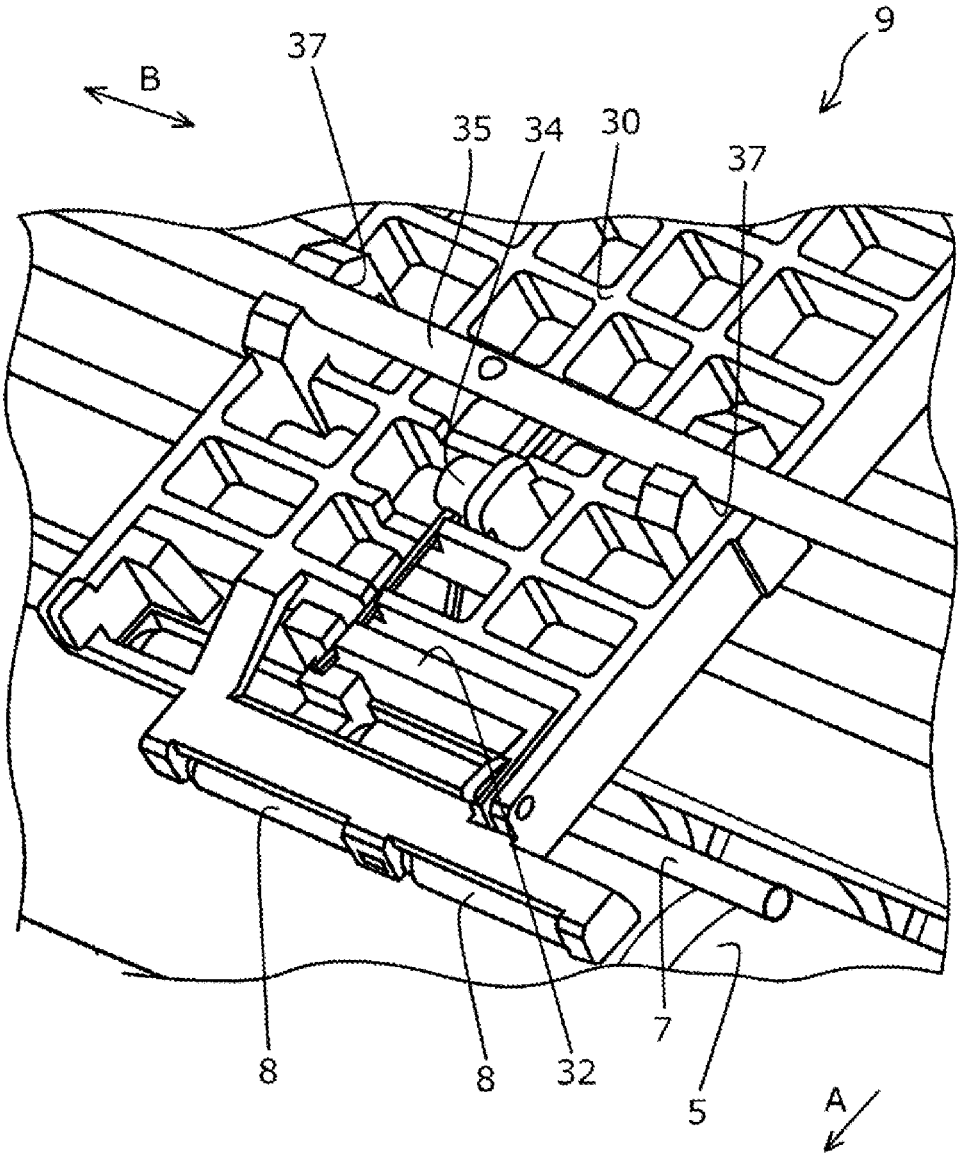
FIG. 7 is a perspective view illustrating the medium conveying device according to Embodiment 1 of the present disclosure, and is a partially enlarged view of FIG. 6.

In addition, as illustrated in FIG. 4, FIG. 5, and FIG. 7, the medium conveying device 9 of the present embodiment includes a first support shaft 35 extending in the intersecting direction B and the first holder 30 has a first hole 37, and the first hole 37 is passed by the first support shaft 35. Then, as illustrated in FIG. 4 and FIG. 5, the first holder 30 has a second support shaft 36 extending in the intersecting direction B, the second holder 32 has a second hole 38, and the second hole 38 is passed by the second support shaft 36. The medium conveying device 9 of the present embodiment easily forms a configuration that by forming a configuration that the first holder 30 is agitated with reference to the first support shaft 35 and a configuration in which the second holder 32 is agitated with reference to the second support shaft 36, the first driven roller 8 presses toward the driving roller 5, and a configuration that the second driven roller 7 presses toward the driving roller 5.

Here, in summary, the medium conveying device 9 of the present embodiment includes the driving roller 5 that applies the driving force to the target recording medium P to convey the target recording medium P. In addition, as illustrated in FIG. 2, the medium conveying device 9 of the present embodiment further includes a first driven roller 8 that presses the target recording medium P toward the driving roller 5. In addition, the medium conveying device 9 of the present embodiment includes the second driven roller 7 that is arranged upstream of the first driven roller 8 in the conveying direction A, and that is configured to contact the target recording medium P entirely in the intersecting direction B to press the target recording medium P toward the driving roller 5. Then, as described above, the driven roller R which is the contact portion of the second driven roller 7 with the target recording medium P, is made from the material capable of adsorbing the plasticizer of the target recording medium P. Further, as described above, the pressing force of the second driven roller 7 is configured to be weaker than the pressing force of the first driven roller 8.

As described above, the medium conveying device 9 of the present embodiment has a configuration in which the second driven roller 7 having the contact portion made from the material capable of adsorbing the plasticizer of the target recording medium P can be brought into contact with the entire portion of the target recording medium P, and the plasticizer can be removed from the entire portion of the target recording medium P. In addition, the medium conveying device 9 of the present embodiment is capable of separating functions into conveyance of the target recording medium P by the first driven roller 8 with a strong pressing force and removal of the plasticizer by the second driven roller 7 with a weak pressing force. That is, the medium conveying device 9 of the present embodiment is configured to that by weakening the pressing force of the second driven roller 7, it is possible to suppress the occurrence of lifting or the like in the target recording medium P to be conveyed at the position between the first driven roller 8 and the second driven roller 7 in the conveying direction A, and it is possible to suppress the conveyance failure of the target recording medium P.

In another aspect, as illustrated in FIG. 1, the liquid discharging device 1 of the present embodiment includes the medium conveying device 9, and the recording head 12 as the discharging unit configured to discharge ink that is a liquid on the target recording medium P to be conveyed in the conveying direction A. In a case where the target recording medium P has unevenness in the plasticizer, the spread of the ink discharged onto the target recording medium P may change, which may cause unevenness in the spread of the ink, but in the liquid discharging device 1 of the present embodiment, unevenness of the plasticizer in the entire target recording medium P can be suppressed. Therefore, the liquid discharging device 1 of the present embodiment can suppress unevenness of the spread of the ink, that is, unevenness of the image formed on the target recording medium P.

Here, in the medium conveying device 9 of the present embodiment, the pressing force of the second driven roller 7 is set to be 1/10 of the pressing force of the first driven roller 8 or less, and 0.1 N or greater. By setting the pressing force of the second driven roller 7 to be 1/10 of the pressing force of the first driven roller 8 or less, it is possible to effectively suppress the occurrence of lifting in the target recording medium P to be conveyed at the position between the first driven roller 8 and the second driven roller 7 in the conveying direction A. In addition, it is possible to effectively remove the plasticizer by setting the pressing force of the second driven roller 7 to be 0.1 N or greater.

Note that the configuration of the second driven roller 7 is not limited to a configuration including one contact portion that is in contact with a medium P in the intersecting direction B, such as the second driven roller 7 of the liquid discharging device 1 of the present embodiment. It may be configured to be in contact with the entire target recording medium P in the intersecting direction B. Here, "in contact with the entire target recording medium P in the intersecting direction B" means that, in addition to the configuration including one contact portion that is in contact with the medium P in the intersecting direction B as described above, a configuration in which a plurality of roller rows in which a plurality of contact portions are arranged in the intersecting direction B are arranged in the intersecting direction A, as in the second driven roller 7 of the liquid discharging device 1 of Embodiment 2 below.

Embodiment 2

FIG. 8

Next, a liquid discharging device 1 of Embodiment 2 will be described hereinafter.

Figure 8:
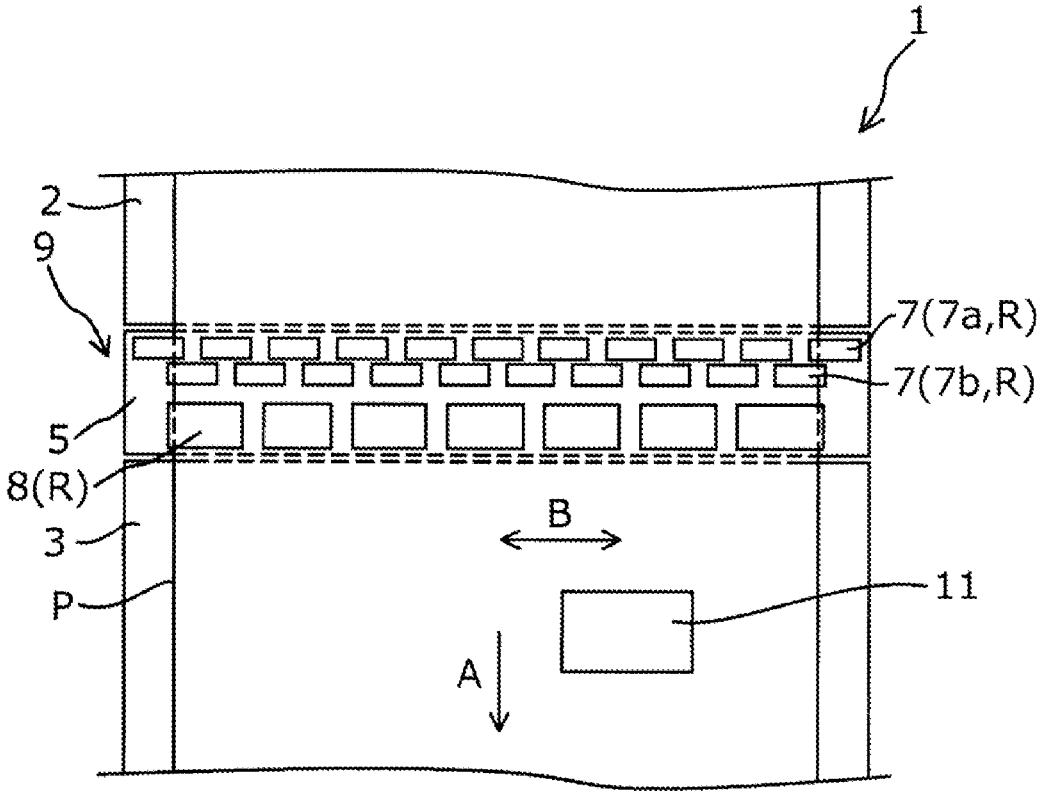
FIG. 8 is a schematic plan view illustrating a liquid discharging device according to Embodiment 2 of the present disclosure.

FIG. 8 is a schematic plan view illustrating a liquid discharging device 1 of the present embodiment, and is a diagram corresponding to FIG. 2 which illustrates the liquid discharging device 1 of Embodiment 1. Note that the constituent members common to those in Embodiment 1 described above are denoted by the same reference numerals, and the detailed description will be omitted. Here, aside from the configuration of the second driven roller 7, the liquid discharging device 1 of the present embodiment has the same configuration as the liquid discharging device 1 of Embodiment 1.

As illustrated in FIG. 8, the liquid discharging device 1 of the present embodiment includes a plurality of downstream driven rollers 7*b* and upstream driven rollers 7*a* arranged at an interval in the intersecting direction B as the second driven rollers 7, the upstream driven rollers 7*a* are arranged upstream of the downstream driven rollers 7*b* in the conveying direction A and press the portion of the target recording medium P which is not pressed by the downstream driven rollers 7*b* toward the driving roller 5. Then, in the downstream driven rollers 7*b* and the upstream driven rollers 7*a* in the conveying direction A, the driven rollers R are arranged in a staggered manner as the contact portions made from a material capable of adsorbing a plasticizer of the target recording medium P. The liquid discharging device 1 of the present embodiment is configured to include the second driven rollers 7 including a plurality of roller rows, so that the second driven rollers 7 can be brought into contact with the entire portion of the target recording medium P with high accuracy. In addition, such a configuration even can deal with such a case that is difficult from the perspective of ensuring the rigidity of the rotation shaft of the driven roller R, which includes one driven roller R in contact with the target recording medium P throughout the intersecting direction B as the second driven roller 7 of the liquid discharging device 1 of Embodiment 1.

The present disclosure is not limited to the present embodiments described above, and can be realized in various configurations without departing from the gist of the present disclosure. Appropriate replacements or combinations may be made to the technical features in the present embodiments which correspond to the technical features in the aspects described in the SUMMARY section to solve some or all of the problems described above or to achieve some or all of the advantageous effects described above. Additionally, when the technical features are not described herein as essential technical features, such technical features may be deleted appropriately.

What is claimed is:

1. A medium conveying device comprising:

a driving roller configured to apply a driving force to a medium to convey the medium;

a first driven roller configured to press the medium toward the driving roller; and a second driven roller that is arranged upstream of the first driven roller in a conveying direction of the medium, and that is configured to contact the medium entirely in an intersecting direction intersecting the conveying direction to press the medium toward the driving roller, wherein a contact portion of the second driven roller contacting the medium includes a material configured to adsorb a plasticizer of the medium, and a pressing force of the second driven roller is weaker than a pressing force of the first driven roller.

2. The medium conveying device according to claim 1, wherein the pressing force of the second driven roller is not more than 1/10 of the pressing force of the first driven roller and not less than 0.1 N.

3. The medium conveying device according to claim 1, wherein the contact portion has an SP value, which is a solubility parameter, of from 8.0 to 10.0.

4. The medium conveying device according to claim 1, wherein the second driven roller includes a roller that is configured to contact the medium entirely in the intersecting direction.

5. The medium conveying device according to claim 1, wherein the second driven roller includes a plurality of downstream driven rollers that are arranged at an interval in the intersecting direction, and upstream driven rollers that are arranged upstream of the downstream driven rollers in the conveying direction and press, toward the driving roller, a portion of the medium that is not pressed by the downstream driven rollers, and the downstream driven rollers and the upstream driven rollers are arranged in a staggered manner in the conveying direction.

6. The medium conveying device according to claim 1, comprising:

a first holder configured to hold the first driven roller;

a second holder that is provided separately from the first holder and is configured to hold the second driven roller;

a first elastic member configured to press the first driven roller toward the driving roller; and a second elastic member configured to press the second driven roller toward the driving roller.

7. The medium conveying device according to claim 6, comprising a first support shaft extending in the intersecting direction, wherein the first holder includes a first hole, and the first support shaft passes through the first hole, the first holder includes a second support shaft extending in the intersecting direction, and the second holder includes a second hole, and the second support shaft passes through the second hole.

8. A liquid discharging device comprising:

the medium conveying device according to claim 1; and a discharging unit configured to discharge liquid onto the medium conveyed in the conveying direction.

* * * * *